US011404798B2

(12) United States Patent
Park

(10) Patent No.: US 11,404,798 B2
(45) Date of Patent: Aug. 2, 2022

(54) MILLIMETER-WAVE DUAL-BAND ANTENNA AND ELECTRONIC DEVICE COMPRISING SAME

(71) Applicant: Samsung Electronics Co., Ltd., Suwon-si (KR)

(72) Inventor: Sung Chul Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 125 days.

(21) Appl. No.: 16/761,463

(22) PCT Filed: Nov. 1, 2018

(86) PCT No.: PCT/KR2018/013188
§ 371 (c)(1),
(2) Date: May 4, 2020

(87) PCT Pub. No.: WO2019/088738
PCT Pub. Date: May 9, 2019

(65) Prior Publication Data

US 2020/0395684 A1 Dec. 17, 2020

(30) Foreign Application Priority Data

Nov. 2, 2017 (KR) ..... 10-2017-0145135

(51) Int. Cl.
*H01Q 21/24* (2006.01)
*H01Q 1/24* (2006.01)
(Continued)

(52) U.S. Cl.
CPC ..... *H01Q 21/24* (2013.01); *H01Q 1/24* (2013.01); *H01Q 1/243* (2013.01); *H01Q 1/38* (2013.01);
(Continued)

(58) Field of Classification Search
CPC ..... H01Q 21/24; H01Q 1/24; H01Q 1/38; H01Q 5/50; H01Q 5/35; H01Q 21/30; H01Q 1/243
(Continued)

(56) References Cited

U.S. PATENT DOCUMENTS 10,439,266 B2 10/2019 Hwang et al.
2005/0140553 A1* 6/2005 Kuramoto ..... H01Q 9/28 343/702
(Continued)

FOREIGN PATENT DOCUMENTS

KR 10-0820758 B1 4/2008
WO 2016/072555 A1 5/2016

OTHER PUBLICATIONS

Hamid Moghadas et al., "A Dual-Band High-Gain Resonant Cavity Antenna With Orthogonal Polarizations", IEEE Antennas and Wireless Propagation Letters, vol. 10, Dec. 2011, p. 1220-1223.
(Continued)

*Primary Examiner* — Hai V Tran

(57) ABSTRACT

An electronic device includes a housing and an antenna array disposed inside the housing. The antenna array includes multiple antenna elements separated in a pattern. At least one of the antenna elements includes a substantially flat conductive plate. The conductive plate includes a partially oval periphery having a first end and a second end, a partial major axis, a minor axis, and a straight periphery that makes a non-zero angle with the partial major axis, contacts or crosses the partial major axis, and interconnects the first end and the second end. A wireless communication circuit is electrically connected to the antenna elements, and transmits a first signal having a first frequency by feeding at or near the straight periphery, and a second signal having a second frequency which is greater than the first frequency by
(Continued)

feeding part of the partially oval periphery at or near the minor axis.

17 Claims, 15 Drawing Sheets

(51) Int. Cl.
*H01Q 5/50* (2015.01)
*H01Q 1/38* (2006.01)
*H01Q 5/35* (2015.01)
*H01Q 21/30* (2006.01)

(52) U.S. Cl.
CPC ..... *H01Q 5/35* (2015.01); *H01Q 5/50* (2015.01); *H01Q 21/30* (2013.01)

(58) Field of Classification Search
USPC ..... 343/702
See application file for complete search history.

(56) References Cited

U.S. PATENT DOCUMENTS

2006/0038723 A1* 2/2006 Watanabe ..... H01Q 1/1271 343/700 MS
2009/0184880 A1* 7/2009 Marklein ..... H01Q 7/00 343/866
2012/0038526 A1* 2/2012 Lim ..... H01Q 1/38 343/713
2012/0229366 A1* 9/2012 Ding ..... H01Q 9/0414 343/907
2017/0117754 A1 4/2017 Noori et al.

OTHER PUBLICATIONS

Mr. P. Arunagiri et al., "A Design of Dual Band Triangular Microstrip Patch Antenna for WLAN Applications", International Journal for Research in Applied Science & Engineering Technology, vol. 4, Issue IV, Apr. 2016, p. 88-92.
Ishan Budhiraja et al., "Slotted Dual Arrowhead Multi-Band Rectangular Microstrip Patch Antenna", International Journal of Scientific & Engineering Research, vol. 3, Issue 9, Sep. 2012, p. 1-5.
International Search Report dated Feb. 18, 2019 in connection with International Patent Application No. PCT/KR2018/013188, 2 pages.
Written Opinion of the International Searching Authority dated Feb. 18, 2019 in connection with International Patent Application No. PCT/KR2018/013188, 7 pages.
Korean Intellectual Property Office, "Notice of Preliminary Rejection" dated Jan. 27, 2022, in connection with Korean Patent Application No. 10-2017-0145135, 14 pages.

* cited by examiner

MILLIMETER-WAVE DUAL-BAND ANTENNA AND ELECTRONIC DEVICE COMPRISING SAME

CROSS-REFERENCE TO RELATED APPLICATIONS

This application is a 371 of International Application No. PCT/KR2018/013188 filed on Nov. 1, 2018, which claims priority to Korean Patent Application No. 10-2017-0145135 filed on Nov. 2, 2017, the disclosures of which are herein incorporated by reference in their entirety.

BACKGROUND

1. Field

Various embodiments of the present disclosure relate to a millimeter-wave dual band antenna for 5G communication and electronic device including the same.

2. Description of Related Art

As wireless communication technology advances, a portable communication device (e.g., a communication electronic device) is widely used in daily life and thus data consumption is exponentially increasing. On account of such a rapid growth in the data consumption, network capacity may gradually reach the limit. In this regard, the wireless communication technology is transferring from current 4th generation wireless communication technology (e.g., a Long Term Evolution (LTE) network) to 5th generation wireless communication technology (e.g., a 5G network).

The 5G wireless communication technology may substantially use a millimeter wave over 25 GHz, and its corresponding communication module may include a plurality of patch-type antenna elements disposed on a dielectric at regular intervals of an array type. The communication module may form a beam in a particular direction and radiate a phase-modified signal in the particular direction through the antenna elements.

For example, the patch-type antenna element may be formed as an oval or rectangular conductive plate on the dielectric. The patch-type antenna element may be subject to radiation degradation in a specific band (e.g., a relatively high frequency band) due to an edge shape which is unnecessary.

Various embodiments of the present disclosure provide a method and apparatus including a millimeter-wave dual band antenna for improving performance.

Various embodiments of the present disclosure provide a method and apparatus including a millimeter-wave dual band antenna which is tuned to achieve relatively good performance in a main operating frequency band.

SUMMARY

According to various embodiments, an electronic device may include a housing, an antenna array which is disposed inside the housing and includes a plurality of antenna elements separated in a pattern, at least one of the antenna elements including a substantially flat conductive plate which is in a partially oval shape, the conductive plate comprising: a partially oval periphery which includes a first end and a second end, a partial major axis, a minor axis which is perpendicular to the major axis, and a straight periphery which makes a non-zero angle with the partial major axis, contacts or crosses the partial major axis, and interconnects the first end and the second end, and at least one wireless communication circuit which is electrically connected to the antenna elements, and is configured to transmit a first signal having a first frequency by feeding at or near the straight periphery, and a second signal having a second frequency which is greater than the first frequency by feeding part of the partially oval periphery at or near the minor axis.

According to various embodiments, an electronic device may include a housing, an antenna array which is disposed inside the housing and includes a plurality of antenna elements arranged in a pattern, at least one of the antenna elements including a substantially flat conductive plate which is in a partially rectangular shape, the conductive plate including a first periphery, a second periphery which is longer than the first periphery and extends substantially perpendicularly from the first periphery, a third periphery which is in parallel with the first periphery, extends from the second periphery, and is shorter than the first periphery, a fourth periphery which extends from the third periphery, and a fifth periphery which is in parallel with the second periphery, extends from the fourth periphery to the first periphery, and is shorter than the second periphery, and a wireless communication circuit which is electrically connected to the antenna elements, and is configured to transmit a first signal having a first frequency by feeding at or near the first periphery, and a second signal having a second frequency which is greater than the first frequency by feeding part of the fifth periphery.

According to various embodiments, an electronic device may include a housing, an antenna array which is disposed inside the housing and includes a plurality of antenna elements separated in a pattern, at least one of the antenna elements including a flat conductive plate, the conductive plate including a first pattern unit in a specific length, a second pattern unit which extends from one end of the first pattern unit in a first length, and a third pattern unit which extends from one end of the first pattern unit at a specific angle with the second pattern unit, and has a second length which is longer than the first length, and at least one wireless communication circuit which is electrically connected to the antenna elements, and is configured to transmit a first signal having a first frequency corresponding to the first pattern unit by feeding near other end of the first pattern unit, and a second signal having a second frequency, corresponding to the second pattern unit, which is smaller than the first frequency.

Various embodiments of the present disclosure improve the radiation performance and the performance of a specific frequency band by partially cutting unnecessary edges of the antenna element or forming specific slits in some areas.

DETAILED DESCRIPTION

Figure 1:
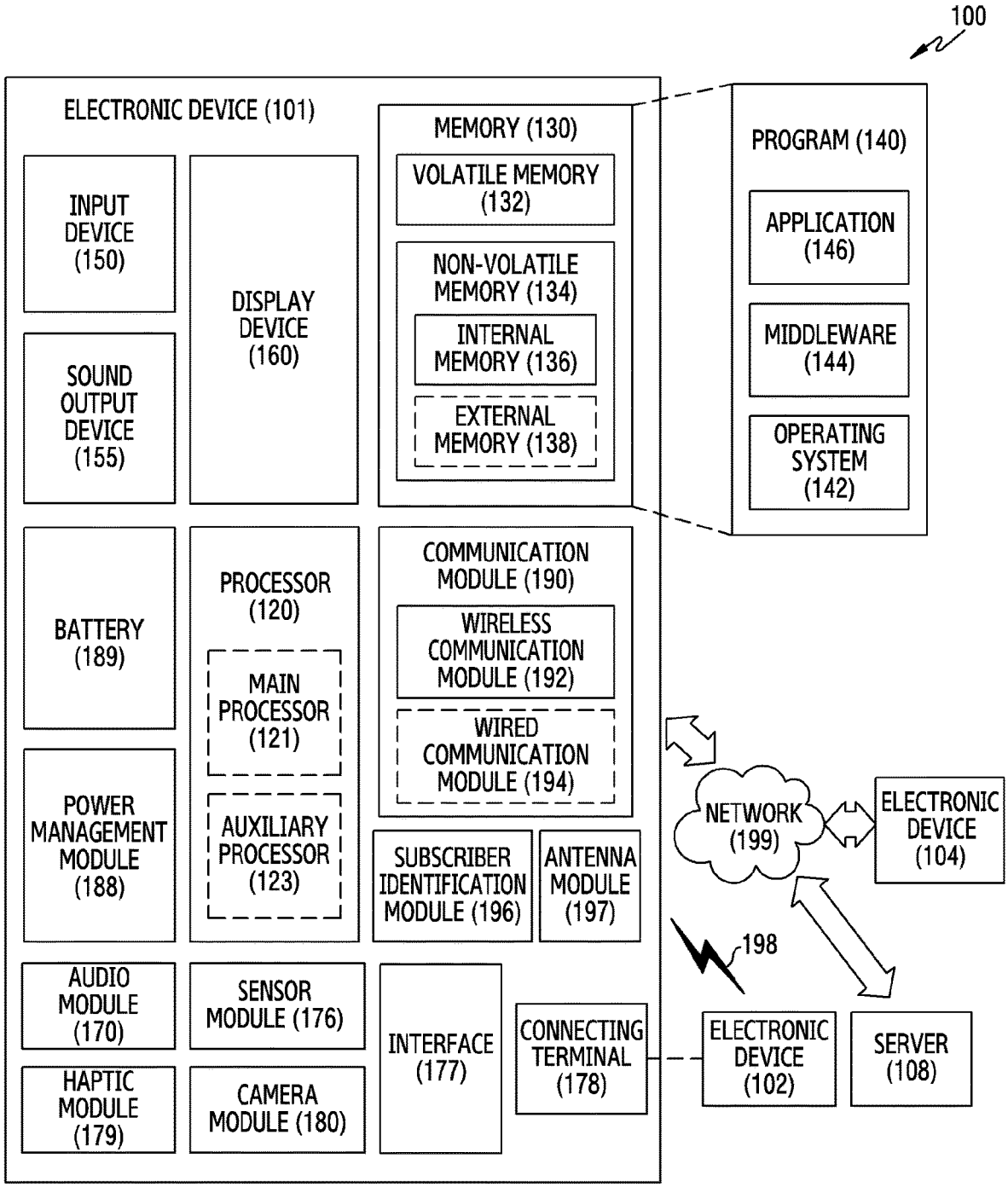
FIG. 1 is a block diagram of an electronic device in a network environment according to various embodiments of the present disclosure.

FIG. 1 is a block diagram illustrating an electronic device 101 in a network environment 100 according to various embodiments.

Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123. The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, or a keyboard.

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other.

The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include one or more antennas, and, therefrom, at least one antenna appropriate for a communication scheme used in the communication network, such as the first network 198 or the second network 199, may be selected, for example, by the communication module 190 (e.g., the wireless communication module 192). The signal or the power may then be transmitted or received between the communication module 190 and the external electronic device via the selected at least one antenna.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

The electronic device according to various embodiments may be one of various types of electronic devices. The electronic devices may include, for example, a portable communication device (e.g., a smart phone), a computer device, a portable multimedia device, a portable medical device, a camera, a wearable device, or a home appliance. According to an embodiment of the disclosure, the electronic devices are not limited to those described above.

It should be appreciated that various embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., Play Store™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

Figure 2A:
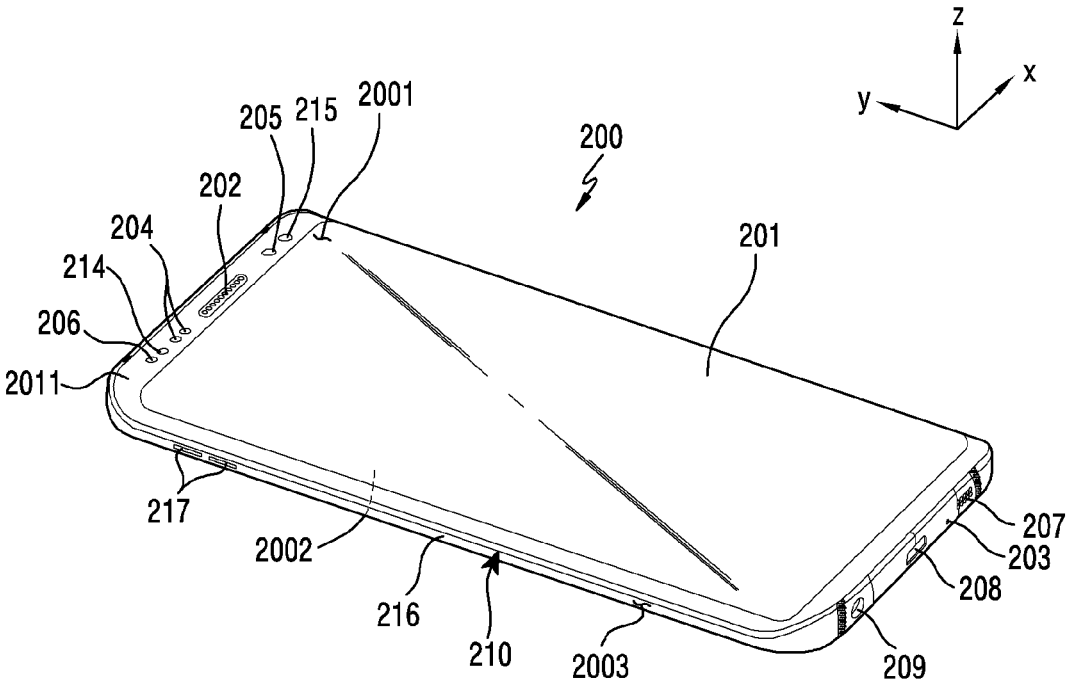
FIG. 2A and FIG. 2B are perspective views of an electronic device according to various embodiments of the present disclosure.
Figure 2B:
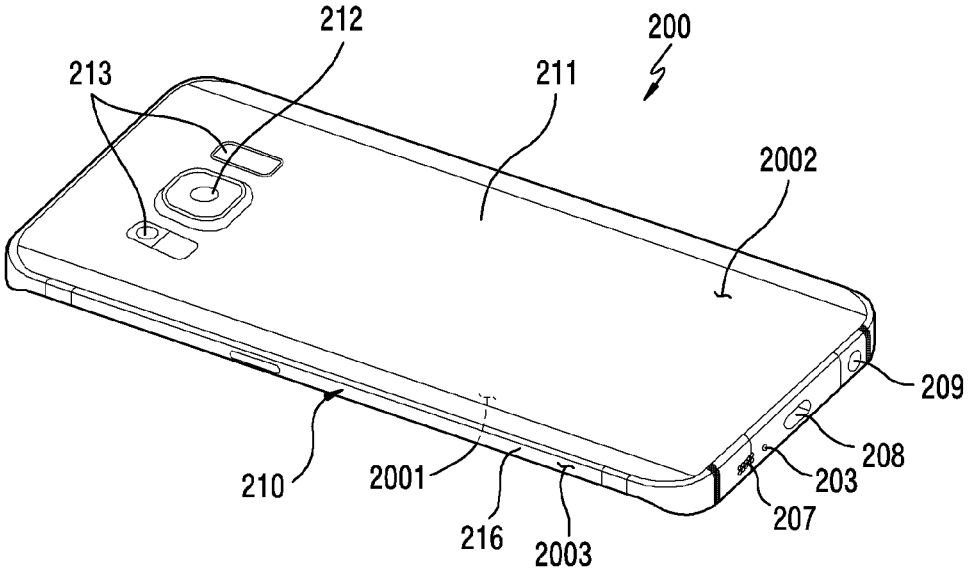

FIG. 2A and FIG. 2B are perspective views of an electronic device according to various embodiments of the present disclosure.

FIG. 2A may be a front perspective view of the electronic device, and FIG. 2B may be a rear perspective view of the electronic device.

The electronic device 200 of FIG. 2A and FIG. 2B may be at least in part similar to the electronic device 101 of FIG. 1, or include other embodiments of the electronic device.

Referring to FIG. 2A and FIG. 2B, the electronic device 200 (e.g., the electronic device 100) may include a housing 210. According to an embodiment, the housing 210 may be formed with a conductive member and/or a nonconductive member. According to an embodiment, the housing 210 may include a first surface 2001 (e.g., a front surface or an upper surface) facing a first direction (e.g., a Z axis direction), a second surface 2002 (e.g., a rear surface or a back surface) disposed in the opposite direction of the first surface 2001, and a side surface 2003 disposed to surround at least part of the first surface 2001 and the second surface 2002. According to an embodiment, the side surface 2003 may be coupled with a front plate 2011 and a rear plate 211, and be formed by a side member 216 including a metal and/or a polymer. According to an embodiment, the electronic device 200 may include the front plate 2011 (e.g., a window or a glass plate) disposed on the first surface 2001, and may expose a display 201 through the front plate 2011. According to an embodiment, the electronic device 200 may include a call receiver hole 202. According to an embodiment, the electronic device 200 may be controlled to use a speaker disposed therein and to talk to other party through the call receiver hole 202. According to an embodiment, the electronic device 200 may include a microphone hole 203. According to an embodiment, the electronic device 200 may use at least one microphone which is disposed therein to detect a sound direction, and receive an external sound or transmit user's voice to the other party through the microphone hole 203. According to an embodiment, the electronic device 200 may include at least one key input device 217. According to an embodiment, the key input device 217 may include at least one side key button 217 disposed in the side member 216 of the housing 210. According to an embodiment, the at least one side key button 217 may include a volume control button, a wakeup button, or a particular function button (e.g., an artificial intelligence execute function or a quick voice recognition launch mode entry function).

According to various embodiments, the electronic device 200 may include components which are exposed or the display 201 or not exposed to function through the front plate 2011, for various functions of the electronic device 200. According to an embodiment, the components may include at least one sensor module 204. The sensor module 204 may include, for example, an illuminance sensor (e.g., an optical sensor), a proximity sensor (e.g., an optimal sensor), an infrared sensor, an ultrasonic sensor, a fingerprint scanning sensor, a face recognition sensor, or an iris scanning sensor. According to an embodiment, the components may include a first camera device 205. According to an embodiment, the components may include an indicator 206 (e.g., a light emitting diode (LED) device) for visually providing a user with state information of the electronic device 200. According to an embodiment, the components may include a light source 214 (e.g., an infrared LED) disposed in one side of the receiver 202. According to an embodiment, the components may include an imaging sensor assembly 215 (e.g., an iris camera) for detecting an iris image by emitting the light from the light source 214 to a user's eye. According to an embodiment, at least one of the components may be exposed through at least part of the second surface 2002 (e.g., the rear surface or the back surface) facing the opposite direction (e.g., −Z direction) of the first direction of the electronic device 200.

According to various embodiments, the electronic device 200 may include an external speaker hole 207. According to an embodiment, the electronic device 200 may use an internal speaker, and emit sound through the external speaker hole 207. According to an embodiment, the electronic device 200 may include a first connector hole 208 (e.g., an interface connector port) which transceives data and receives an external power of an external device to charge the electronic device 200. According to an embodiment, the electronic device 200 may include a second connector hole 209 (e.g., an ear jack assembly) for receiving an ear jack of an external device.

According to various embodiments, the electronic device 200 may include a back plate 211 (e.g., a back window) disposed on the second surface 2002. According to an embodiment, the back plate 211 may include a rear-facing camera device 212. At least one electronic component 213 may be disposed near the rear-facing camera device 212. According to an embodiment, the electronic component 213 may include at least one of an illuminance sensor (e.g., an optical sensor), a proximity sensor (e.g., an optimal sensor), an infrared sensor, an ultrasonic sensor, a heart rate sensor, a fingerprint scanning sensor, or a flash device.

According to various embodiments, the display 201 may include the front plate 2011 exposed through at least part of the first surface 2001 of the electronic device 200. According to an embodiment, the display 201 may include a touch panel and a display panel which are layered on the back of the front plate 2011. According to an embodiment, an image displayed through the display panel may be provided to the user through the front plate 2011 which is transparent. According to an embodiment, the front plate 2011 may employ various transparent materials such as a glass or an acrylic.

According to various embodiments, the electronic device 200 may include at least one communication module (e.g., a communication module 400 of FIG. 4A) which uses the millimeter wave (e.g., a frequency band over 25 GHz) as its operating frequency band. According to an embodiment, the communication module may include an antenna array including a plurality of antenna elements (e.g., antenna elements 420, 430, and 440 of FIG. 4A) disposed at regular intervals, and each antenna element may form a beam in at least one direction and transmit and receive signals in the beamed direction through a communication circuit (e.g., radio frequency integrated circuits (RFICs) 311, 321, 331, and 341 of FIG. 3). According to an embodiment, a phase changing means (e.g., a phase shifter) may be included near the communication module. According to an embodiment, the phase changing means may change a phase of the communication module.

According to various embodiments, the antenna element may be configured as a patch type in a specific shape. According to an embodiment, the antenna element may operate in a dual band (e.g., 28 GHz band and 39 GHz band). According to an embodiment, by cutting at least part from an edge, the antenna element may avoid radiation degradation due to the edge.

Figure 3:
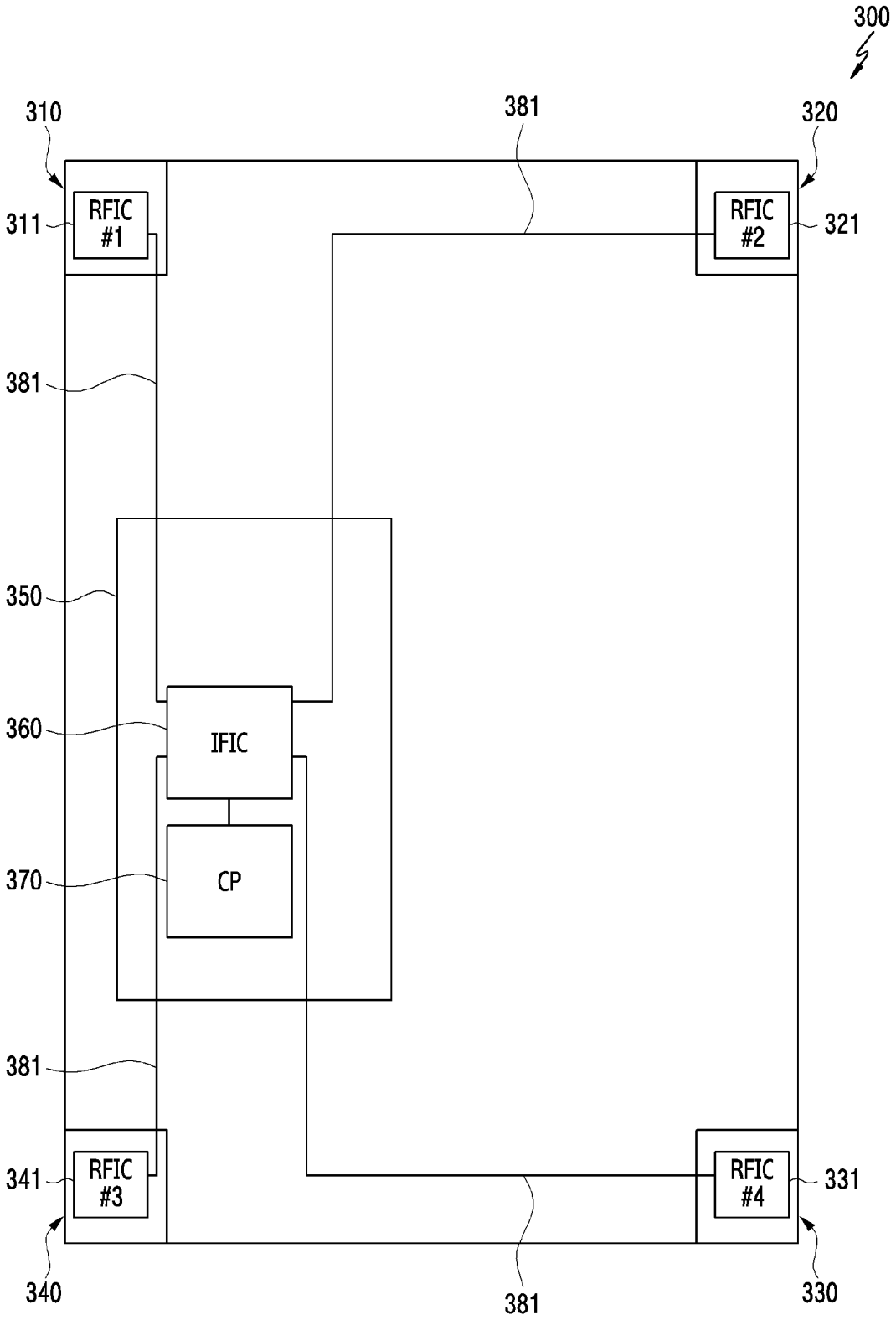
FIG. 3 is a diagram of communication modules in an electronic device according to various embodiments of the present disclosure.

FIG. 3 is a diagram of communication modules in an electronic device according to various embodiments of the present disclosure.

An electronic device 300 of FIG. 3 may be at least in part similar to the electronic device 101 of FIG. 1 or the electronic device 200 of FIG. 2A, and include other embodiments of the electronic device.

Referring to FIG. 3, the electronic device 300 may include a plurality of communication modules 310, 320, 330, and 340. According to an embodiment, the communication modules 310, 320, 330, and 340 may include a plurality of patch-type conductive plates which are disposed as an array at regular intervals on a dielectric (e.g., a printed circuit board (PCB)), are formed in a specific shape (e.g., an oval or rectangular shape), and operate as antenna elements (e.g., the antenna elements 420, 430, and 440 of FIG. 4A). According to an embodiment, the antenna elements may transmit and receive signals through communication circuits (e.g., the RFIC 311, 321, 331, and 341) on the dielectric.

According to various embodiments, the electronic device 300 may include a PCB 350 (e.g., a main PCB) mounted in an inner space. The PCB 350 may include a processor 370 (e.g., a CP) and an intermediate frequency IC (IFIC) 360. According to an embodiment, the communication circuit (e.g., the RFIC) disposed in the communication module may be electrically connected to the IFIC 360 by an electrical connecting member 381 (e.g., a coaxial cable). According to an embodiment, signals transceived through the communication modules 310, 320, 330, and 340 may be converted to IF signals through the RFICs 311, 321, 331, and 341, and the IF signals may be converted to baseband signals through the IFIC 361 and provided to the processor 370.

According to various embodiments, while the communication modules 310, 320, 330, and 340 are disposed at, but not limited to, the edges, they may be disposed in various numbers at various positions in the inner space of the electronic device 300. According to an embodiment, at least two of the communication modules 310, 320, 330, and 340 may operate together. For example, at least one communication module may be selectively switched by a sensor device according to an ambient environment. According to an embodiment, the sensor device may include a grip sensor, and the electronic device may detect its grip through the grip sensor and control to operate the communication module at a position to avoid the grip.

Now, the communication module shall be described in detail.

Figure 4A:
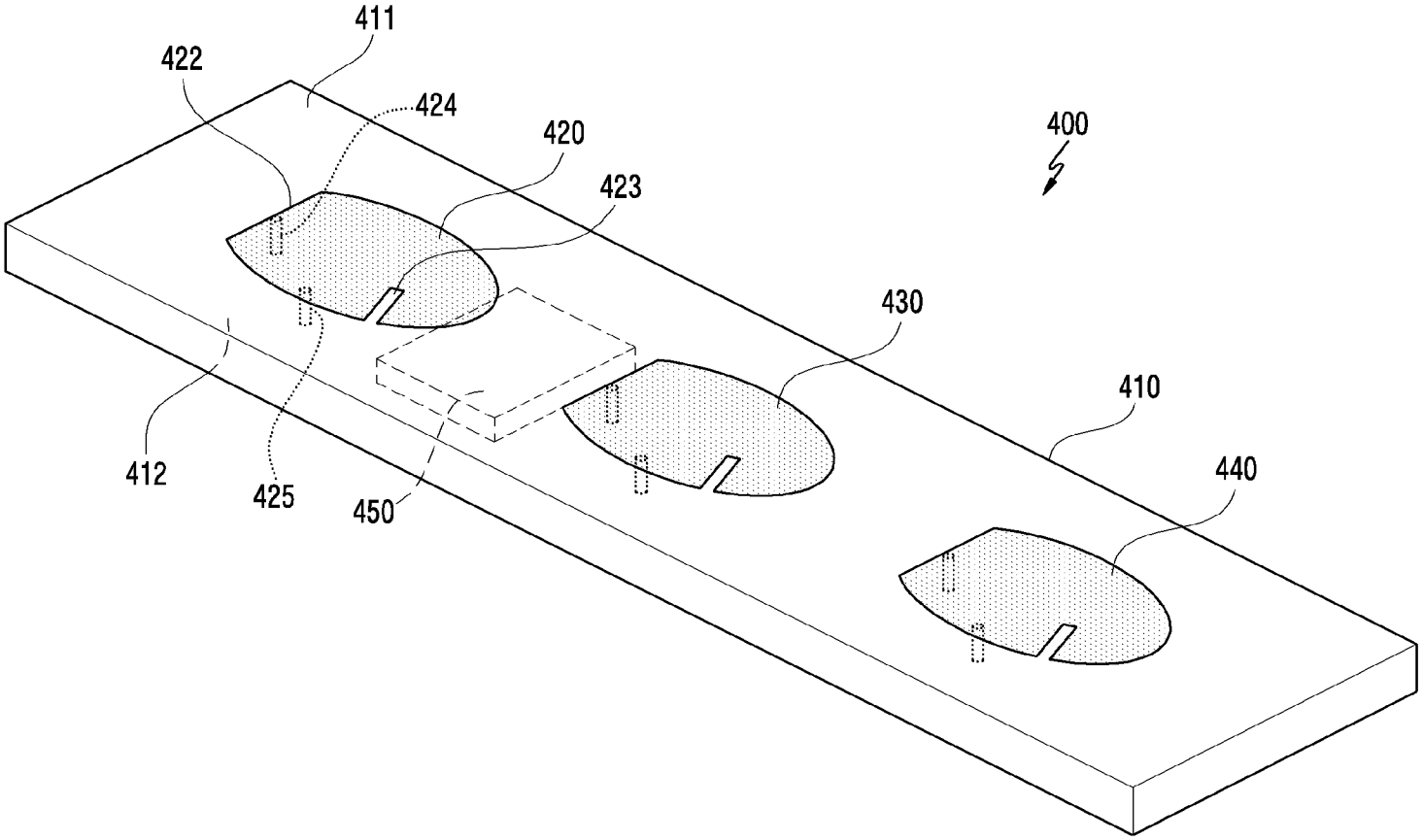
FIG. 4A is a diagram of a communication module according to various embodiments of the present disclosure.

FIG. 4A is a diagram of a communication module according to various embodiments of the present disclosure.

The communication module 400 of FIG. 4A may be at least in part similar to the communication modules 310, 320, 330, and 340 of FIG. 3, or include other embodiments of the communication module.

Referring to FIG. 4A, the communication module 400 may include a dielectric 410, and a plurality of antenna elements 420, 430, and 440 disposed as an array at regular intervals on the dielectric 410. According to an embodiment, the antenna elements 420, 430, and 440 may include a conductive plate which is, but not limited to, attached or formed as a patch on the dielectric 410. The antenna elements 420, 430, and 440 may include a conductive paint which is spread on the dielectric 410.

According to various embodiments, the dielectric 410 may include a PCB. According to an embodiment, the dielectric 410 may include a first surface 411 which faces a first direction, and a second surface 412 which faces a second direction which is opposite to the first direction. According to an embodiment, the antenna elements 420, 430, and 440 may be disposed at regular intervals on the first surface 411 of the dielectric 410. The antenna elements 420, 430, and 440 may be electrically connected to a communication circuit (e.g., an RFIC) on the second surface 412 of the dielectric 410.

Figure 4B:
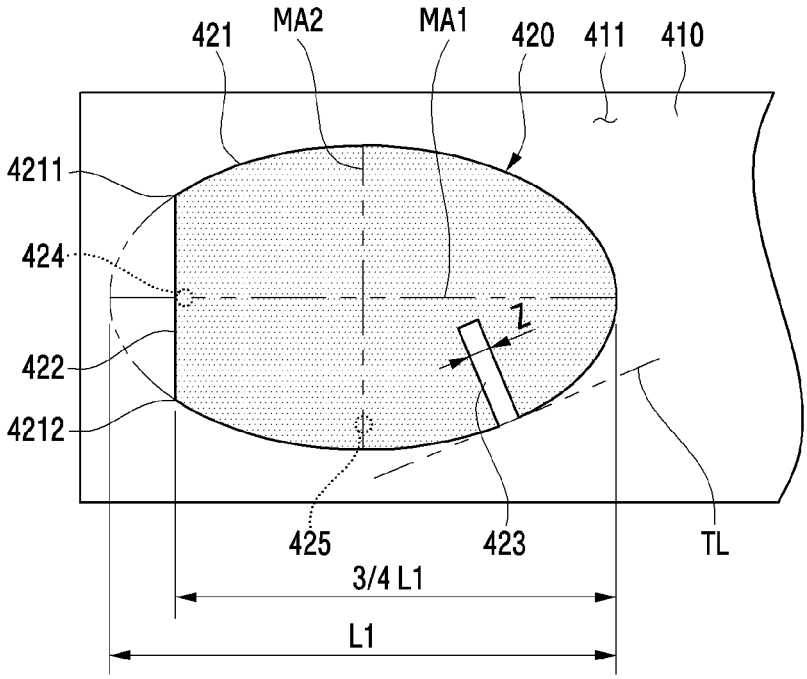
FIG. 4B is a diagram of an antenna element of the communication module according to various embodiments of the present disclosure.

According to various embodiments, the antenna element 420 may be formed substantially in an oval shape including a partial major axis (e.g., a major axis MA1 of FIG. 4B) and a minor axis (e.g., a minor axis MA2 of FIG. 4B). According to an embodiment, the antenna element 420 may include a straight periphery 422 which contacts or crosses the partial major axis to make a non-zero angle with the partial major axis. According to an embodiment, the antenna element 420 may include a slit 423 in a specific width and a specific length to make a non-zero angle with the partial major axis. According to various embodiments, by means of the straight periphery 422 and the slit 423, the antenna element 420 may improve radiation of the communication module by reducing a fringe which hinders the radiation due to the complete oval structure of the antenna element 420. According to an embodiment, the antenna element 420 may control the radiation of the operating frequency band at the major axis or the minor axis by adjusting the width (e.g., a width Z of FIG. 4B) of the straight periphery 422 and/or the slit 423.

According to various embodiments, the antenna element 420 may include a first feeder 424 which feeds a wireless communication circuit to issue a first signal including a first frequency near the straight periphery 422, and a second feeder 425 which feeds the wireless communication circuit to issue a second signal including a second frequency which is greater than the first frequency near the minor axis.

FIG. 4B is a diagram of the antenna element of the communication module according to various embodiments of the present disclosure.

While the structure of one antenna element 420 is described in the following, it is apparent that the other antenna elements 430 and 440 of the antenna elements 420, 430, and 440 may have at least the same structure as the antenna element 420.

Referring to FIG. 4B, the antenna element 420 may be formed in a partially oval shape. According to an embodiment, the antenna element 420 may include a flat conductive plate on the first surface 411 of the dielectric 410. According to an embodiment, the antenna element 420 may include a partially oval periphery 421 including a first end 4211 and a second end 4212, the partial major axis MA1, the minor axis MA2 which is perpendicular to the partial major axis MA1, and the straight periphery 422 which makes a non-zero angle with the partial major axis MA1, contacts or crosses the partial major axis MA1, and interconnects the first end 4211 and the second end 4212. According to an embodiment, the communication module (e.g., the communication module 400 of FIG. 4A) may include at least one wireless communication circuit (e.g., the communication circuit (e.g., the RFIC) 311 of FIG. 3) which is electrically connected to the antenna element 420 and transmits the first signal including the first frequency generated by feeding the first feeder 424 near the straight periphery 422, and the second signal generated by feeding the second feeder 425 at part of the partially oval periphery 421 near the minor axis MA2 and including the second frequency which is greater than the first frequency. According to an embodiment, a length of the partial major axis MA1 may be about ¾(¾×L1) of a total major axis length L1 of a virtual complete oval which includes no straight periphery 422.

According to various embodiments, the first frequency may include a range of 25 GHz~35 GHz, and the second frequency may include a range of ~35 GHz 45 GHz. According to an embodiment, the first frequency may include the operating frequency band of 28 GHz, and the second frequency may include the operating frequency band of 39 GHz.

According to various embodiments, the slit 423 may be disposed on the other side of the minor axis MA2 from the straight periphery 422. According to an embodiment, the slit 423 may extend from one point of the partially oval periphery 421 in a direction perpendicular to a virtual tangent line TL. According to an embodiment, the slit 423 may be formed at an about ½ point between the major axis MA1 and the minor axis MA2 of the partially oval periphery 421. According to an embodiment, the length of the slit 423 may not exceed the major axis.

According to various embodiments, the antenna element 420 may tune the radiation according to the width Z of the slit 423. Table 1 shows gain variations of the communication module according to the width Z of the slit 423 of the antenna element 420.

TABLE 1

| Operating Frequency | Conventional Antenna | Antenna of the present disclosure Z = 0.05 mm | Antenna of the present disclosure Z = 0.2 mm | Expected Value |
|---|---|---|---|---|
| 28 GHz | 8.57 dB | 8.49 dB | 8.33 dB | 8.81 dB |
| 39 GHz | 5.73 dB | 6.43 dB | 6.81 dB | 7.15 dB |

As shown in Table 1, if the width of the slit 423 of the antenna element 420 is 0.05 mm, the gain is 8.49 dB in the 28 GHz band using the major axis MA1 and is 8.49 dB in the 39 GHz band using the minor axis MA2. According to an embodiment, if the width Z of the slit 423 is 0.2 mm, the gain is 8.33 dB in the 28 GHz band using the major axis MA1 and is 6.81 dB in the 39 GHz band using the minor axis MA2. According to an embodiment, the gain in the 39 GHz band improves as the width Z of the slit 423 of the antenna element 420 increases, the gain in the 28 GHz band improves as the width decreases, and the width Z of the slit 423 may be adjusted according to the main operating frequency band.

Figure 5A:
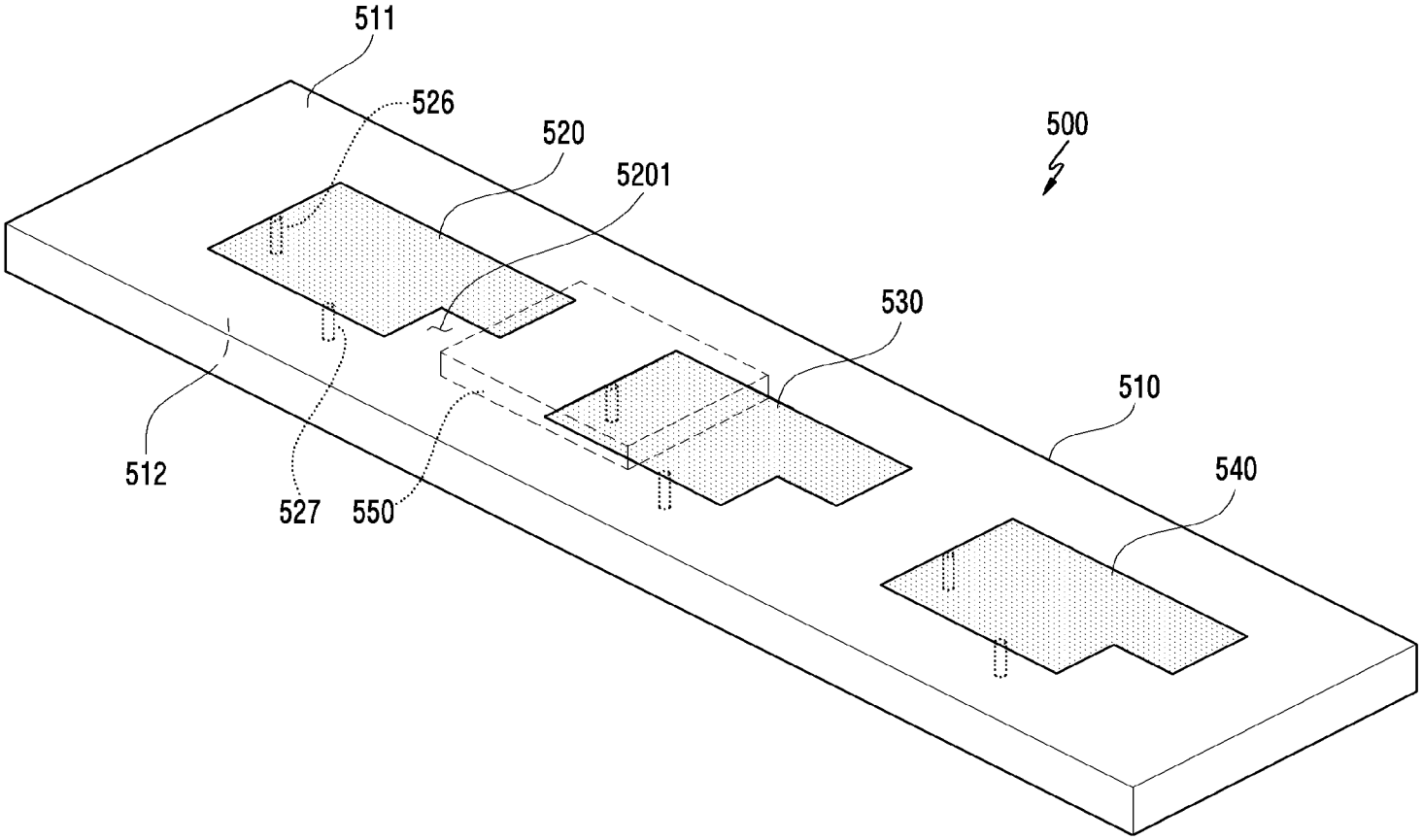
FIG. 5A is a diagram of a communication module according to various embodiments of the present disclosure.

FIG. 5A is a diagram of a communication module according to various embodiments of the present disclosure.

A communication module 500 of FIG. 5A may be at least in part similar to the communication modules 310, 320, 330, and 340 of FIG. 3, or include other embodiments of the communication module.

Referring to FIG. 5A, the communication module 500 may include a dielectric 510, and a plurality of antenna elements 520, 530, and 540 disposed as an array at regular intervals on the dielectric 510. According to an embodiment, the antenna elements 520, 530, and 540 may include a conductive plate which is, but not limited to, attached or formed as a patch on the dielectric 510. The antenna elements 520, 530, and 540 may include a conductive paint which is spread on the dielectric 510.

According to various embodiments, the dielectric 510 may include a PCB. According to an embodiment, the dielectric 510 may include a first surface 511 which faces a first direction, and a second surface 512 which faces a second direction which is opposite to the first direction. According to an embodiment, the antenna elements 520, 530, and 540 may be disposed at regular intervals on the first surface 511 of the dielectric 510. The antenna elements 520, 530, and 540 may be electrically connected to a communication circuit (e.g., an RFIC) (e.g., the communication module 190 or the wireless communication module 192 of FIG. 1, or the communication circuit (e.g., RFIC) 311 of FIG. 3) on the second surface 512 of the dielectric 510.

Figure 5B:
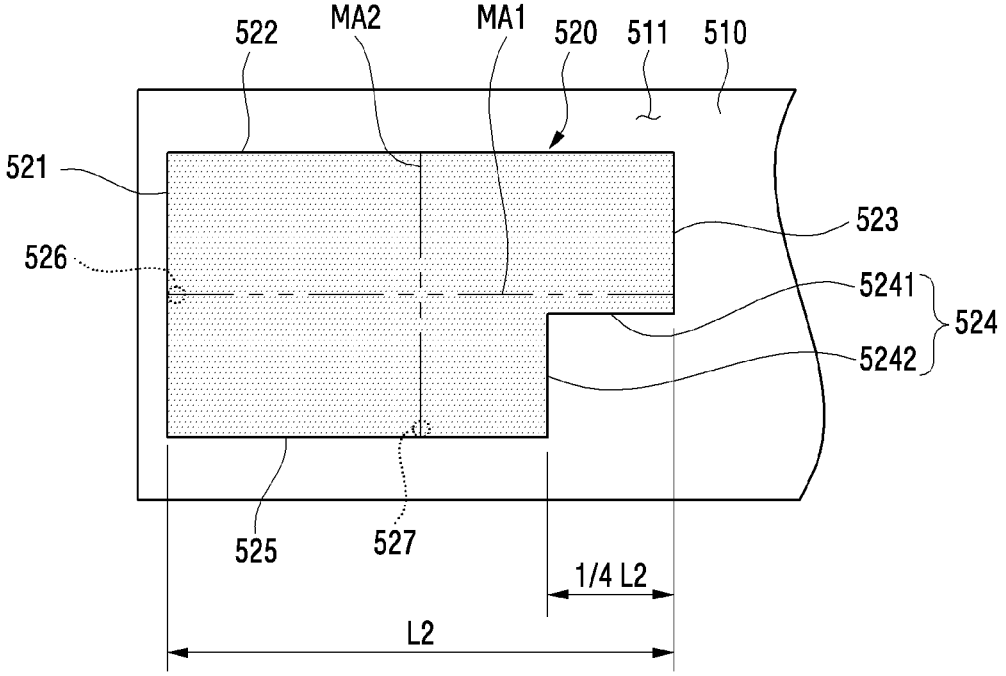
FIG. 5B is a diagram of an antenna element of the communication module according to various embodiments of the present disclosure.

According to various embodiments, the antenna element 520 may be formed substantially in a rectangular shape including a partial major axis (e.g., a major axis MA1 of FIG. 5B) and a minor axis (e.g., a minor axis MA2 of FIG. 5B). According to an embodiment, the antenna element 520, of which at least part of an edge is cut, may improve radiation of its operating frequency band at the major axis or the minor axis, by reducing a fringe which hinders the radiation due to a complete rectangular structure.

According to various embodiments, the antenna element 520 may include a first feeder 526 which feeds a wireless communication circuit to issue a first signal including a first frequency near one end of the major axis, and a second feeder 527 which feeds the wireless communication circuit to issue a second signal including a second frequency which is greater than the first frequency near one end of the minor axis.

FIG. 5B is a diagram of the antenna element of the communication module according to various embodiments of the present disclosure.

While the structure of one antenna element 520 is described in the following, it is apparent that the other antenna elements 530 and 540 of the antenna elements 520, 530, and 540 may have at least the same structure as the antenna element 520.

Referring to FIG. 5B, the antenna element 520 may be formed in a partially rectangular shape. According to an embodiment, the antenna element 520 may include a substantially flat conductive plate on the first surface 511 of the dielectric 510. According to an embodiment, the antenna element 420 may include a first periphery 521, a second periphery 522 which extends substantially vertically from the first periphery 521, a third periphery 523 which extends from the second periphery 522 in parallel with the first periphery 521 and is shorter than the first periphery 521, a fourth periphery 524 which extends from the third periphery 523, and a fifth periphery 525 which extends from the fourth periphery 524 to the first periphery 521 in parallel with the second periphery 522 and is shorter than the second periphery 522. According to an embodiment, the communication module (e.g., the communication module 500 of FIG. 5A) may include at least one wireless communication circuit (e.g., the communication circuit (e.g., the RFIC) 311 of FIG. 3) which is electrically connected to the antenna element 520 and is configured to transmit a first signal having a first frequency generated by feeding the first feeder 526 near the first periphery 521, and a second signal generated by feeding the second feeder 527 near the fifth periphery 525 and including a second frequency which is greater than the first frequency. According to an embodiment, the fourth periphery 524 may include a first side 5241 which extends from the third periphery 523 in parallel with the second periphery 522, and a second side 5242 which extends from the first side 5241 in parallel with the third periphery 523. According to an embodiment, the fourth periphery 524 may be formed in a quadrangular shape by the first side 5241 and the second side 5242.

According to various embodiments, a length of the fifth periphery 525 may be about ¾(¾×L2) of a length L2 of the whole virtual fifth periphery 525 of a virtual complete rectangle including no fourth periphery 524. According to an embodiment, the fourth periphery 524 may be formed up to a position not exceeding ½ of the virtual length of the third periphery 523.

According to various embodiments, the first frequency may include a range of 25 GHz 35 GHz, and the second frequency may include a range of 35 GHz 45 GHz. According to an embodiment, the first frequency may include the operating frequency band of 28 GHz, and the second frequency may include the operating frequency band of 39 GHz.

Figure 6:
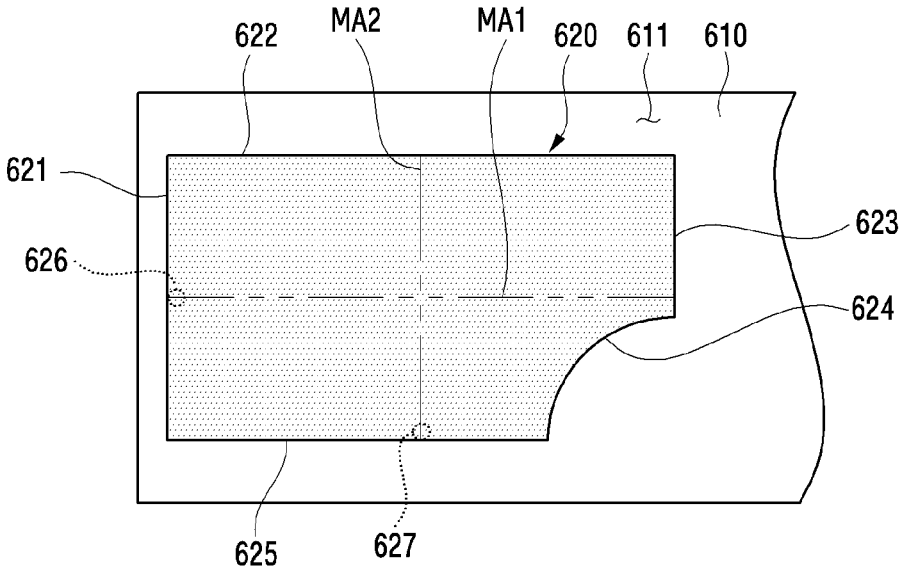
FIG. 6 is a diagram of an antenna element according to various embodiments of the present disclosure.

FIG. 6 is a diagram of an antenna element according to various embodiments of the present disclosure.

In an antenna element 620 disposed in a first side 611 of a dielectric 610 of FIG. 6, a first periphery 621, a second periphery 622, a third periphery 623, a fifth periphery 625, a first feeder 626, and a second feeder 627 may have the same or similar configuration to the antenna element 520 of FIG. 5. According to an embodiment, a fourth periphery 624 of the antenna element 620 of FIG. 6 may be formed in a curved shape with a specific curvature, unlike the quadrangular antenna element 520 of FIG. 5B. According to an embodiment, the fourth periphery 624 may be curved, but not limited to, inwards. The fourth periphery 624 may be curved outwards.

According to various embodiments, the antenna element 520 and 620 may turn the radiation according to the cutting shape of the fourth periphery 524 and 624. Table 2 shows gain variations of the communication module based on the shape of the fourth periphery 524 and 624 of the antenna element 520 and 620.

TABLE 2

| | | Antenna of the present disclosure | | |
|---|---|---|---|---|
| Operating Frequency | Conventional Antenna | Rectangular shape | Curved shape | Expected Value |
| 28 GHz | 8.57 dB | 8.25 dB | 8.61 dB | 8.81 dB |
| 39 GHz | 5.73 dB | 7.14 dB | 6.87 dB | 7.15 dB |

As shown in Table 2, if the fourth periphery 524 of the antenna element 520 is rectangular, the gain is 8.25 dB in the 28 GHz band using the major axis MA1 and is 8.61 dB in the 39 GHz band using the minor axis MA2. According to an embodiment, if the fourth periphery 624 is curved, the gain is 7.14 dB in the 28 GHz band using the major axis MA1 and is 6.87 dB in the 39 GHz band using the minor axis MA2. According to an embodiment, the gain improves in the 28 GHz band if the fourth periphery 624 is cut in the curved shape, rather than the quadrangular shape. By contrast, the gain improves in the 39 GHz band if the fourth periphery 624 is cut in the quadrangular shape, rather than the curved shape. According to an embodiment, depending on the cutting shape of the fourth periphery 524 and 624 of the antenna element 520 and 620, performance of a desired operating frequency band of the communication module 500 and 600 may be regulated.

According to various embodiments, the fourth periphery 524 and 624 may include, but not limited to, the quadrangular or curved cut shape as shown in FIG. 5B and FIG. 6. The fourth periphery 524 and 624 may be formed in various shapes for the sake of the antenna performance improvement. For example, the fourth periphery 524 and 624 may be cut in various shapes such as a triangle.

Figure 7A:
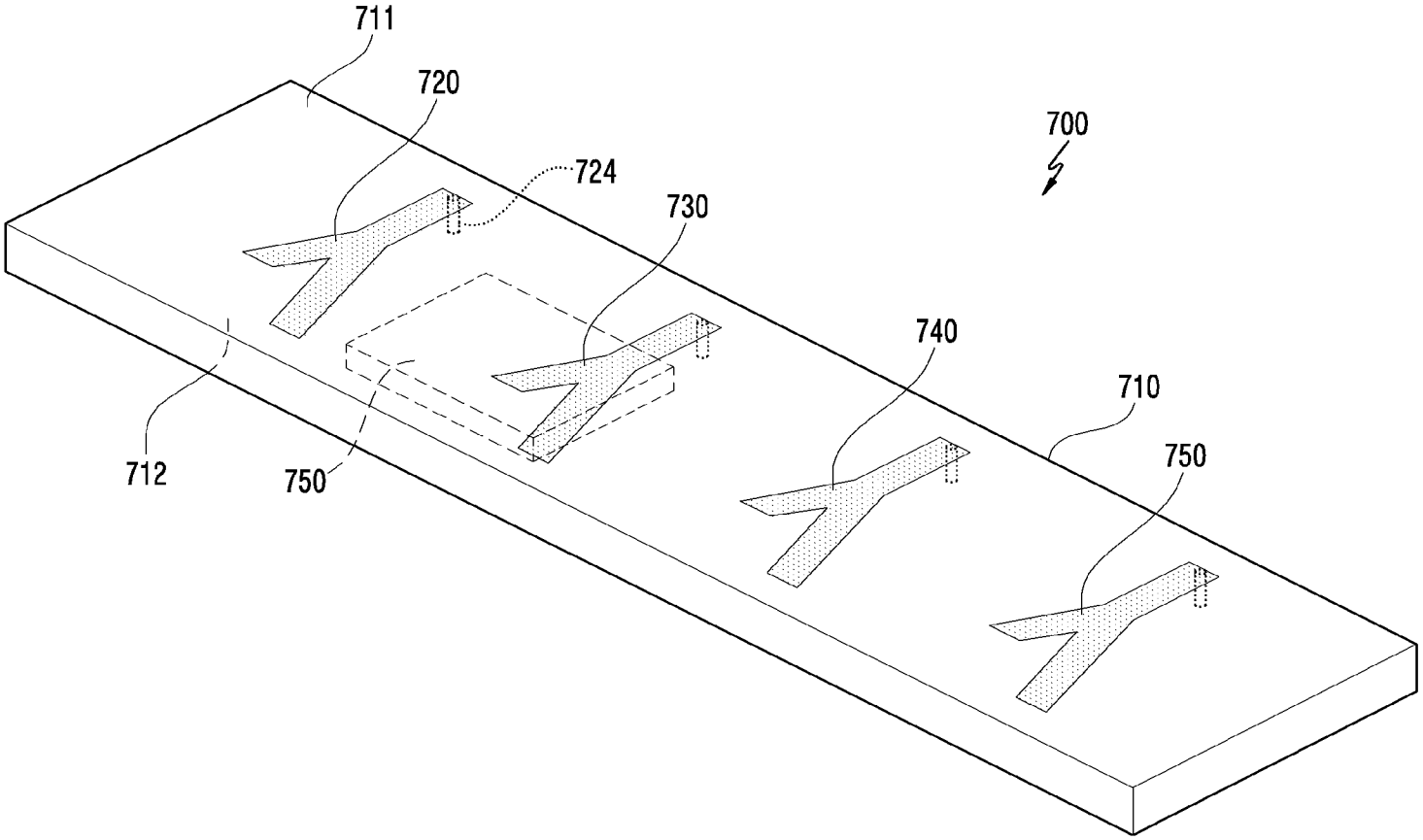
FIG. 7A is a diagram of a communication module according to various embodiments of the present disclosure.

FIG. 7A is a diagram of a communication module according to various embodiments of the present disclosure.

A communication module 700 of FIG. 7A may be at least in part similar to the communication modules 310, 320, 330, and 340 of FIG. 3, or include other embodiments of the communication module.

According to various embodiments, an antenna element may operate in a dual band using one feed point.

Referring to FIG. 7A, the communication module 700 may include a dielectric 710, and a plurality of antenna elements 720, 730, 740, and 750 disposed at regular intervals on the dielectric 710. According to an embodiment, the antenna elements 720, 730, 740, and 750 may include a conductive plate which is, but not limited to, attached or formed as a patch on the dielectric 710. The antenna elements 720, 730, 740, and 750 may include a conductive paint which is spread on the dielectric 710.

According to various embodiments, the dielectric 710 may include a PCB. According to an embodiment, the dielectric 710 may include a first surface 711 which faces a first direction, and a second surface 712 which faces a second direction which is opposite to the first direction. According to an embodiment, the antenna elements 720, 730, 740, and 750 may be disposed at regular intervals on the first surface 711 of the dielectric 710. The antenna elements 720, 730, 740, and 750 may be electrically connected to a communication circuit (e.g., an RFIC) (e.g., the communication module 190 or the wireless communication module 192 of FIG. 1, or the communication circuit (e.g., RFIC) 311 of FIG. 3) on the second surface 712 of the dielectric 710.

According to various embodiments, the antenna element 720 may include a single feeder 724 at one end, and operate in different frequency bands (e.g., 28 GHz band and 39 GHz band) according to patterns which are divided (e.g., divided in a 'Y' shape) from the feeder 724 to respective ends.

Figure 7B:
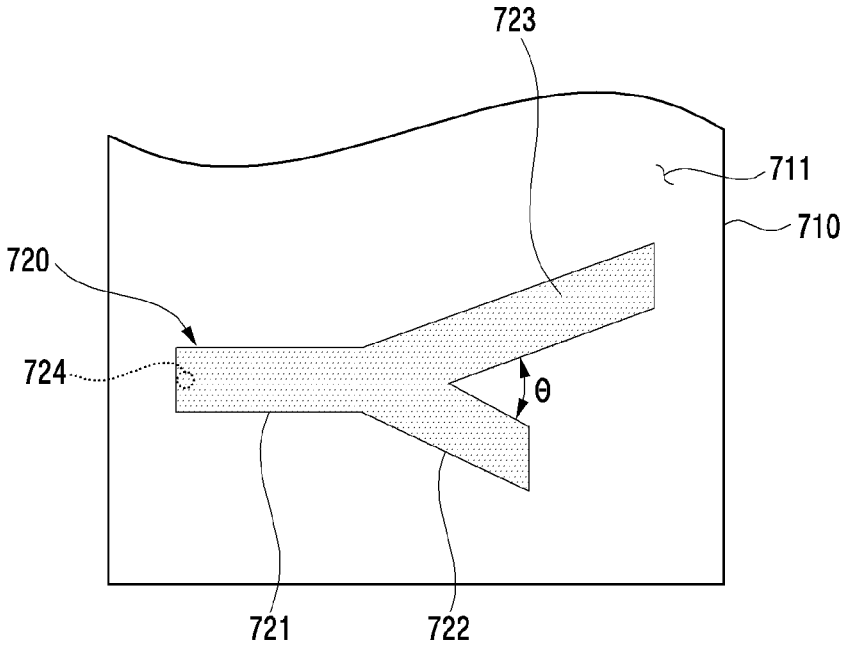
FIG. 7B is a diagram of an antenna element of the communication module according to various embodiments of the present disclosure.

FIG. 7B is a diagram of the antenna element of the communication module according to various embodiments of the present disclosure.

While the structure of one antenna element 720 is described in the following, it is apparent that the other antenna elements 730, 740, and 750 of the antenna elements 720, 730, 740, and 750 may have at least the same structure as the antenna element 720.

Referring to FIG. 7B, the antenna element 720 may include the feeder 724 at one end. the antenna element 720 may include a first pattern unit 721 which is formed in a particular length, and a second pattern unit 722 and a third pattern unit 723 which are divided from one end of the first pattern unit 721 at a specific angle. According to an embodiment, the communication module (e.g., the communication module 700 of FIG. 7A) may include at least one wireless communication circuit (e.g., the communication circuit (e.g., the RFIC) 311 of FIG. 3) which is electrically connected to the first pattern unit 721 of the antenna element 720 and is configured to transmit a first signal including a first frequency generated by the second pattern unit 722 and a second signal including a second frequency which is generated by the third pattern unit 723 and is smaller than the first frequency. According to an embodiment, the second pattern unit 722 and the third pattern unit 723 may have different lengths. For example, the second pattern unit 722 and the third pattern unit 723 may have a specific angle θ. According to an embodiment, the angle θ may range 55°±10°. According to an embodiment, the second pattern unit 722 and/or the third pattern unit 723 may bend at a specific angle so as not to match a virtual extension line of the first pattern unit 721.

According to various embodiments, the first frequency may include a range of 35 GHz~45 GHz, and the second frequency may include a range of 25 GHz~35 GHz. According to an embodiment, the first frequency may include the operating frequency band of 39 GHz, and the second frequency may include the operating frequency band of 28 GHz.

Figure 8:
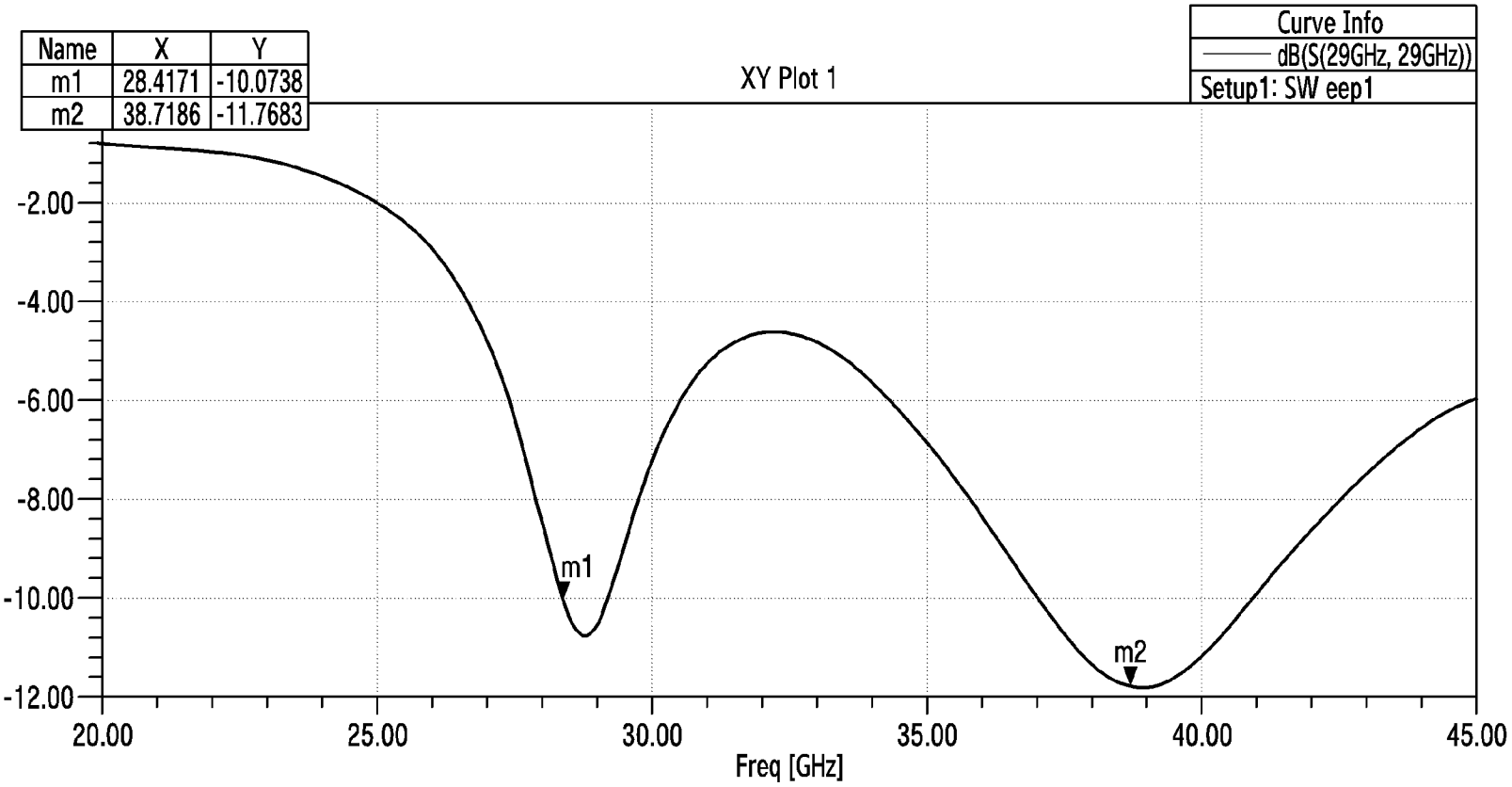
FIG. 8 is a S11 graph of a return loss of an antenna based on configurations of FIG. 7A and FIG. 7B according to various embodiments of the present disclosure.
Figure 9A:
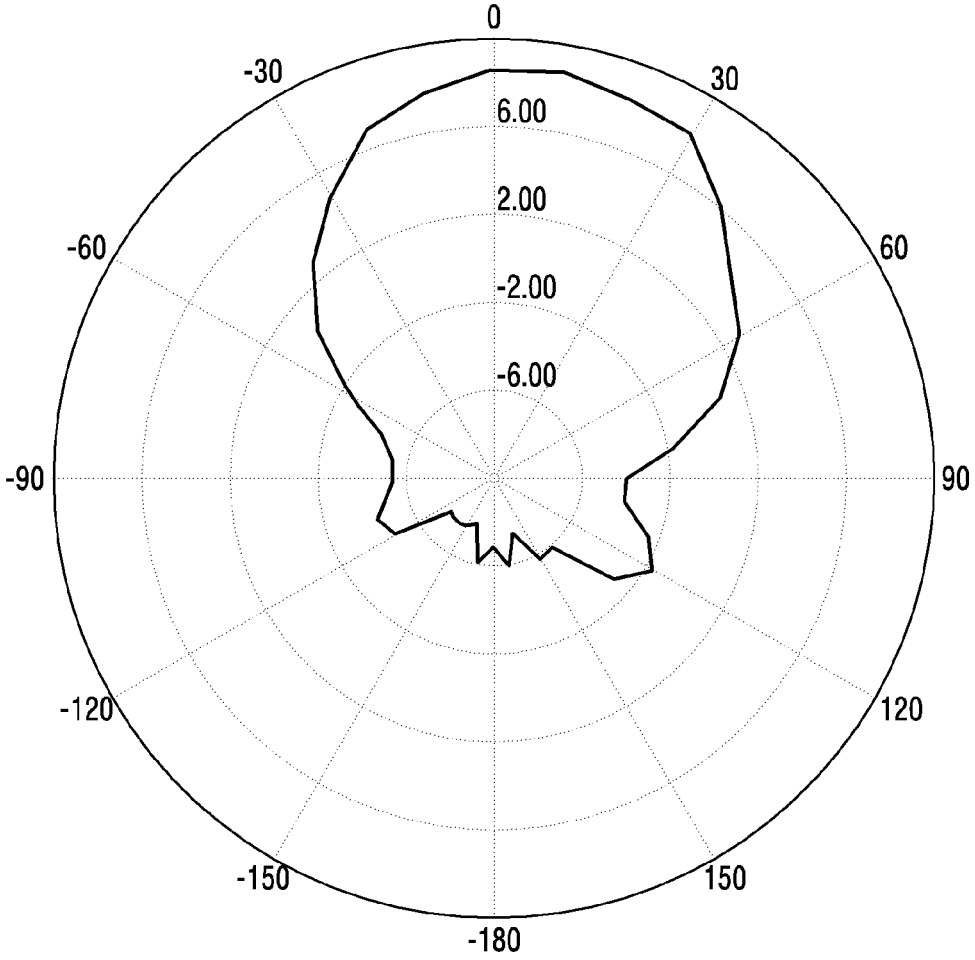
FIG. 9A and FIG. 9B are diagrams of a radiation pattern per frequency of an antenna based on configurations of FIG. 7A and FIG. 7B according to various embodiments of the present disclosure.
Figure 9B:
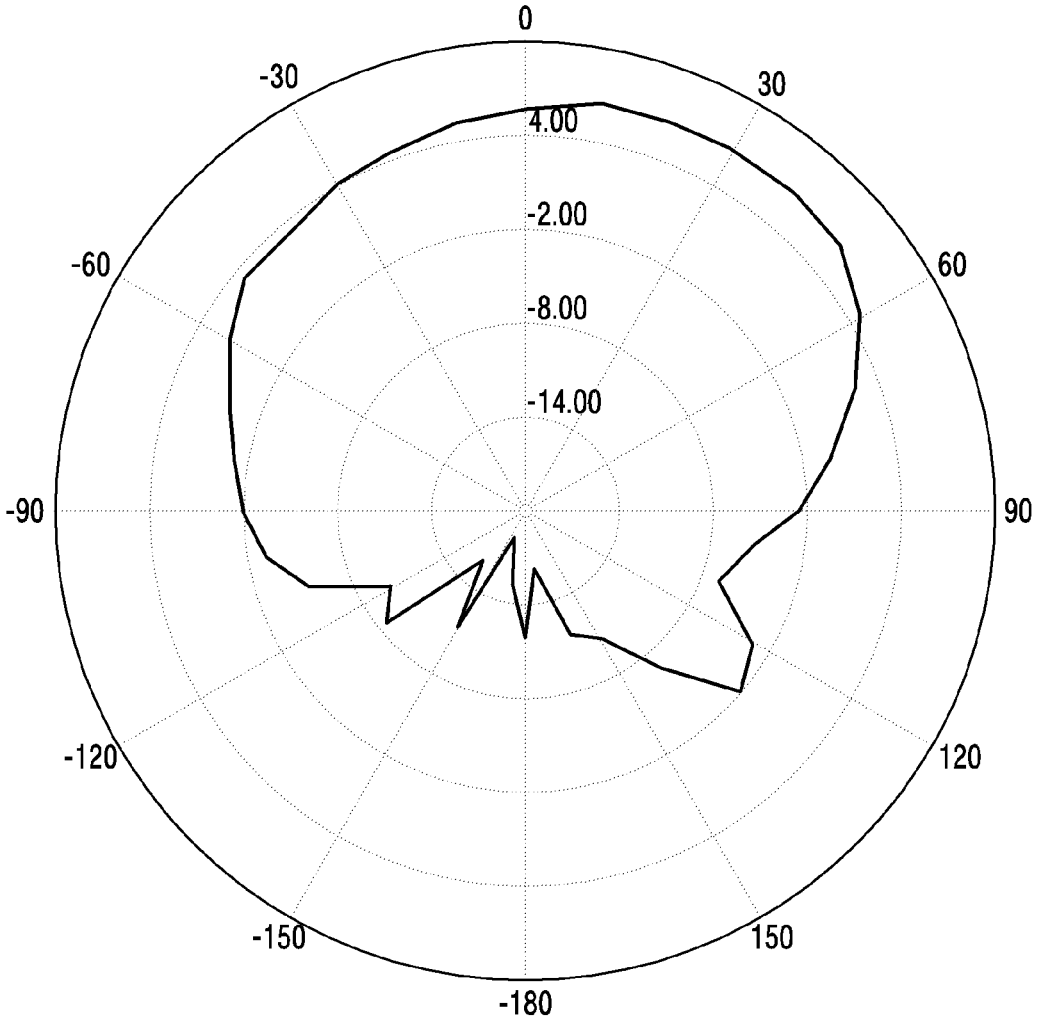

FIG. 8 is a S11 graph of a return loss of an antenna based on the configurations of FIG. 7A and FIG. 7B according to various embodiments of the present disclosure. FIG. 9A and FIG. 9B are diagram of a radiation pattern per frequency of an antenna based on the configurations of FIG. 7A and FIG. 7B according to various embodiments of the present disclosure.

Referring to FIG. 8, FIG. 9A, and FIG. 9B, a gain of an operating frequency band achieved by a second pattern unit (e.g., the second pattern unit 722 of FIG. 7B) is 7.14 dB which is close to an effective maximum expected value 7.15 dB, and a gain of an operating frequency band achieved by a third pattern unit (e.g., the third pattern unit 723 of FIG. 7B) is 8.68 dB which is close to an effective maximum expected value 8.81 dB.

Figure 10:
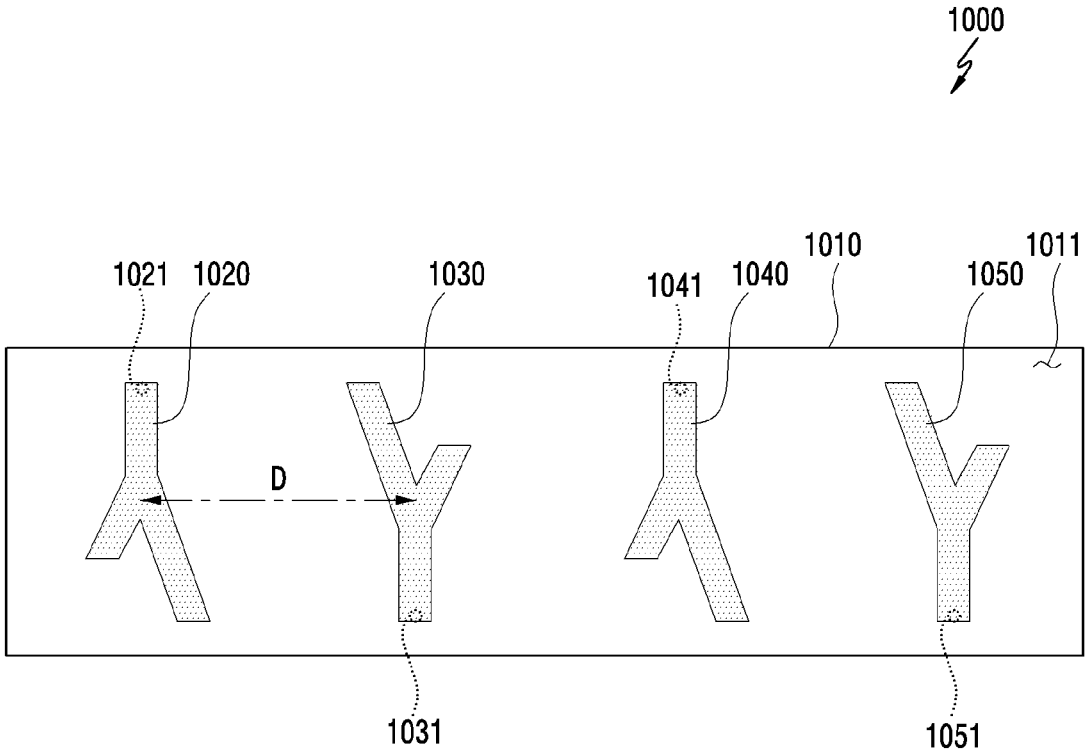
FIG. 10 is a diagram of a communication module with antenna elements to various embodiments of the present disclosure.

FIG. 10 is a diagram of a communication module with antenna elements according to various embodiments of the present disclosure.

The antenna elements which are divided in a 'Y' shape as stated above may be unnecessarily apart from each other due to the pattern units which are split in two, and thus the mounting space of the antenna element may increase.

According to various embodiments of the present disclosure, antenna elements 1020, 1030, 1040, and 1050 of a communication module 1000 may be alternated in opposite directions on a first surface 1011 of a dielectric 1010. For example, the communication module 1000 may include the antenna elements 1020, 1030, 1040, and 1050, the antenna elements 1020, 1030, 1040, and 1050 are disposed with feeders 1021, 1031, 1041, and 1051 heading opposite directions. Hence, the mounting space of the communication module 1000 may be reduced by decreasing a distance D between the antenna elements 1020, 1030, 1040, and 1050.

In addition, the embodiments disclosed in the specification and the drawings merely describe the technical contents according to the embodiments of the disclosure and provide specific examples above to help understanding the embodiments of the disclosure, and the scope of the embodiments of the disclosure is described. It is not intended to be limiting. Accordingly, the scope of various embodiments should be interpreted to include all changes or modified forms derived based on the technical spirit of the various embodiments in addition to the embodiments disclosed herein to be included in the scope of various embodiments.

According to various embodiments, an electronic device may include a housing (e.g., the housing 210 of FIG. 2A), an antenna array (e.g., the antenna array 400 of FIG. 4A) which is disposed inside the housing and includes a plurality of antenna elements (e.g., the antenna elements 420, 430, and 440) separated in a pattern, at least one of the antenna elements including a substantially flat first conductive plate which is in a partially oval shape, the first conductive plate including a partially oval periphery (e.g., the periphery 421 of FIG. 4B) which includes a first end (e.g., the first end 4211 of FIG. 4B) and a second end (e.g., the second end 4212 of FIG. 4B), a partial major axis (e.g., the partial major axis MA1 of FIG. 4B), a minor axis (e.g., the minor axis MA2 of FIG. 4B) which is perpendicular to the major axis, and a straight periphery (e.g., the straight periphery 422 of FIG. 4B) which makes a non-zero angle with the partial major axis, contacts or crosses the partial major axis, and interconnects the first end and the second end, and at least one wireless communication circuit (e.g., the communication module 190 or the wireless communication module 192 of FIG. 1, or the communication circuit (e.g., the RFIC) 311 of FIG. 3) which is electrically connected to the antenna elements, and is configured to transmit a first signal having a first frequency by feeding at or near the straight periphery, and a second signal having a second frequency which is greater than the first frequency by feeding part of the partially oval periphery at or near the minor axis.

According to various embodiments, the wireless communication circuit may be configured to form at least one beam using the antenna elements.

According to various embodiments, the first frequency may be in a range of 25 GHz~35 GHz, and the second frequency may be in a range of 35 GHz~45 GHz.

According to various embodiments, the first frequency may be 28 GHz, and the second frequency may be 39 GHz.

According to various embodiments, the substantially flat first conductive plate may further include a slit which is extended in a direction to make a non-zero angle with the major axis.

According to various embodiments, the slit may be disposed on the opposite side of the minor axis from the straight periphery.

According to various embodiments, the direction may be perpendicular to a virtual tangent line at one point of the partially oval periphery.

According to various embodiments, a length of the partial major axis may be about ¾ of a total major axis length of a virtual complete oval which includes no straight periphery.

According to various embodiments, the slit may be formed at an about ½ point between the major axis and the minor axis of the partially oval periphery.

According to various embodiments, a length of the slit may not exceed the major axis.

According to various embodiments, at least one of the antenna elements further comprises a substantially flat second conductive plate which is in a partially rectangular shape, wherein the second conductive plate including a first periphery (e.g., the first periphery 521 of FIG. 5B), a second periphery (e.g., the second periphery 522 of FIG. 5B) which is longer than the first periphery and extends substantially perpendicularly from the first periphery, a third periphery (e.g., the third periphery 523 of FIG. 5B) which is in parallel with the first periphery, extends from the second periphery, and is shorter than the first periphery, a fourth periphery (e.g., the fourth periphery 524 of FIG. 5B) which extends from the third periphery, and a fifth periphery (e.g., the fifth periphery 525 of FIG. 5B) which is in parallel with the second periphery, extends from the fourth periphery to the first periphery, and is shorter than the second periphery, wherein at least one of the wireless communication circuit (e.g., the communication module 190 or the wireless communication module 192 of FIG. 1, or the communication circuit (e.g., the RFIC) 311 of FIG. 3) is configured to be electrically connected to the antenna elements, and transmit a third signal having a third frequency by feeding at or near the first periphery, and a fourth signal having a fourth frequency which is greater than the third frequency by feeding part of the fifth periphery.

According to various embodiments, the fourth periphery may include a first side (e.g., the first side 5241 of FIG. 5B) which extends from the third periphery in parallel with the second periphery, and a second side (e.g., the second side 5242 of FIG. 5B) which extends from the first periphery in parallel with the third periphery.

According to various embodiments, the fourth periphery may be formed in a curved shape.

According to various embodiments, at least one of the antenna elements further comprises a flat third conductive plate, wherein the third conductive plate including a first pattern unit (e.g., the first pattern unit 721 of FIG. 7B) in a specific length, a second pattern unit (e.g., the second pattern unit 722 of FIG. 7B) which extends from one end of the first pattern unit in a first length, and a third pattern unit (e.g., the third pattern unit 723 of FIG. 7B) which extends from one end of the first pattern unit at a specific angle with the second pattern unit, and has a second length which is longer than the first length, wherein at least one wireless communication circuit (e.g., the communication module 190 or the wireless communication module 192 of FIG. 1, or the communication circuit (e.g., the RFIC) 311 of FIG. 3) is configured to be electrically connected to the antenna elements, and transmit a fifth signal having a fifth frequency corresponding to the first pattern unit by feeding near other end of the first pattern unit, and a sixth signal having a sixth frequency, corresponding to the second pattern unit, which is smaller than the fifth frequency.

According to various embodiments, the antenna elements may be alternated in opposite directions.

According to various embodiments, the second pattern unit and/or the third pattern unit may be bent at a specific angle not to match a virtual extension line of the first pattern unit.

According to various embodiments, the angle may range 55°±10°.

According to various embodiments, the first frequency may be in a range of 35 GHz~45 GHz, and the second frequency may be in a range of 25 GHz~35 GHz.

What is claimed is:

1. An electronic device comprising:

a housing;

an antenna array which is disposed inside the housing and comprises a plurality of antenna elements separated in a pattern, a first antenna element of the antenna elements corresponding to a substantially flat first conductive plate which is in a partially oval shape, the first conductive plate comprising:

a first partially oval periphery which comprises a first end and a second end, a first partial major axis, a first minor axis which is perpendicular to the first partial major axis, a first straight periphery which makes a non-zero angle with the first partial major axis, contacts or crosses the first partial major axis, and interconnects the first end and the second end, and a first slit extended in a direction to make a non-zero angle with the first partial major axis; and at least one wireless communication circuit which is electrically connected to the first antenna element, and is configured to transmit a first signal having a first frequency by feeding at or near the first straight periphery, and a second signal having a second frequency which is greater than the first frequency by feeding part of the first partially oval periphery at or near the first minor axis.

2. The electronic device of claim 1, wherein the wireless communication circuit is configured to form at least one beam using the antenna elements.

3. The electronic device of claim 1, wherein the first frequency is in a range of 25 GHz~35 GHz, and the second frequency is in a range of 35 GHz~45 GHz.

4. The electronic device of claim 3, wherein the first frequency is 28 GHz, and the second frequency is 39 GHz.

5. The electronic device of claim 1, wherein the first slit is disposed on an opposite side of the first minor axis from the first straight periphery.

6. The electronic device of claim 5, wherein the direction is perpendicular to a virtual tangent line at one point of the first partially oval periphery.

7. The electronic device of claim 1, wherein a length of the first partial major axis is about ¾ of a total major axis length of a virtual complete oval which comprises no straight periphery.

8. The electronic device of claim 1, wherein the first slit is formed at an about ½ point between the first partial major axis and the first minor axis of the first partially oval periphery.

9. The electronic device of claim 1, wherein a length of the first slit does not exceed the first partial major axis.

10. The electronic device of claim 1, wherein a second antenna element of the antenna elements corresponds to a substantially flat second conductive plate which is in a partially rectangular shape, wherein the second conductive plate comprising:

a first periphery;

a second periphery which is longer than the first periphery and extends substantially perpendicularly from the first periphery;

a third periphery which is in parallel with the first periphery, extends from the second periphery, and is shorter than the first periphery;

a fourth periphery which extends from the third periphery; and a fifth periphery which is in parallel with the second periphery, extends from the fourth periphery to the first periphery, and is shorter than the second periphery, wherein the at least one wireless communication circuit is electrically connected to the antenna elements, and is configured to transmit a third signal having a third frequency by feeding at or near the first periphery, and a fourth signal having a fourth frequency which is greater than the third frequency by feeding part of the fifth periphery.

11. The electronic device of claim 10, wherein the fourth periphery comprises a first side which extends from the third periphery in parallel with the second periphery, and a second side which extends from the first periphery in parallel with the third periphery.

12. The electronic device of claim 10, wherein the fourth periphery is formed in a curved shape.

13. The electronic device of claim 1, wherein a second antenna element of the antenna elements corresponds to a flat third conductive plate, wherein the third conductive plate comprising:

a first pattern unit in a specific length, a second pattern unit which extends from one end of the first pattern unit in a first length, and a third pattern unit which extends from one end of the first pattern unit at a specific angle with the second pattern unit, and has a second length which is longer than the first length, and wherein the at least one wireless communication circuit is electrically connected to the antenna elements, and is configured to transmit a fifth signal having a fifth frequency corresponding to the first pattern unit by feeding near other end of the first pattern unit, and a sixth signal having a sixth frequency, corresponding to the second pattern unit, which is smaller than the fifth frequency.

14. The electronic device of claim 13, wherein the antenna elements are alternated in opposite directions.

15. The electronic device of claim 1, wherein a second antenna element of the antenna elements corresponds to a substantially flat second conductive plate which is in a partially oval shape, the second conductive plate comprising:

a second partially oval periphery which comprises a third end and a fourth end, a second partial major axis, a second minor axis which is perpendicular to the second partial major axis, and a second straight periphery which makes a non-zero angle with the second partial major axis, contacts or crosses the second partial major axis, and interconnects the third end and the fourth end, wherein the second antenna element is disposed with a specific distance from the first antenna element, and wherein the first antenna element and the second antenna element are disposed such that the first partially oval periphery of the first antenna element faces the second straight periphery of the second antenna element.

16. The electronic device of claim 15, wherein the at least one wireless communication circuit which is electrically connected to the second antenna element, and is configured to transmit a third signal having the first frequency by feeding at or near the second straight periphery, and a fourth signal having the second frequency which is greater than the first frequency by feeding part of the second partially oval periphery at or near the second minor axis.

17. The electronic device of claim 15, wherein the second conductive plate comprises a second slit extended in a direction to make a non-zero angle with the second partial major axis.

* * * * *